US009441423B2

(12) United States Patent
Donnally et al.

(10) Patent No.: US 9,441,423 B2
(45) **Date of Patent: *Sep. 13, 2016**

(54) DRILLING RIG MASTS AND METHODS OF ASSEMBLY AND ERECTION

(71) Applicants: Robert Benjamin Donnally, Shanghai (CN); Chunqiao Ren, Shanghai (CN); Stuart Arthur Lyall McCurdy, Edmonton (CA); Xi Lin Liu, Henan (CN); Hui Chun Sheng, Shanghai (CN); Yan Yu, Shanghai (CN)

(72) Inventors: Robert Benjamin Donnally, Shanghai (CN); Chunqiao Ren, Shanghai (CN); Stuart Arthur Lyall McCurdy, Edmonton (CA); Xi Lin Liu, Henan (CN); Hui Chun Sheng, Shanghai (CN); Yan Yu, Shanghai (CN)

(73) Assignee: National Oilwell Varco, L.P., Houston, TX (US)

( * ) Notice: Subject to any disclaimer, the term of this patent is extended or adjusted under 35 U.S.C. 154(b) by 198 days.

This patent is subject to a terminal disclaimer.

(21) Appl. No.: 14/016,703

(22) Filed: Sep. 3, 2013

(65) Prior Publication Data

US 2015/0059262 A1 Mar. 5, 2015

Related U.S. Application Data

(63) Continuation of application No. 12/074,258, filed on Feb. 29, 2008, now Pat. No. 8,549,815.

(51) Int. Cl.

| | |
|---|---|
| ***E21B 15/00*** | (2006.01) |
| ***E21B 7/02*** | (2006.01) |
| *B66C 23/30* | (2006.01) |
| *B66C 23/26* | (2006.01) |

(52) U.S. Cl.
CPC ..... *E21B 15/00* (2013.01); *E21B 7/02* (2013.01); *B66C 23/26* (2013.01); *B66C 23/30* (2013.01); *E21B 7/026* (2013.01)

(58) Field of Classification Search
CPC ..... E21B 15/00; E21B 7/02; E21B 7/26; B66C 23/26; B66C 23/30; B66C 23/34; B66C 23/344; E04H 12/34
USPC ..... 52/123.1, 111, 117, 118, 120, 745.17, 52/745.18; 173/28, 1, 24, 85, 161, 184
See application file for complete search history.

(56) References Cited

U.S. PATENT DOCUMENTS 2,429,010 A 10/1947 Woolslayer et al.
2,583,072 A 1/1952 Wilson (Continued)

OTHER PUBLICATIONS

PCT Search Report and Written Opinion from PCT/US2012/048030 dated Oct. 16, 2013.

(Continued)

*Primary Examiner* — Phi A
(74) *Attorney, Agent, or Firm* — Amerson Law Firm, PLLC

(57) ABSTRACT

A system for erecting a drilling rig mast includes a substructure having an open area that is defined therein by two laterally spaced-apart substructure sides and a first mast section that is adapted to be positioned at least partially within the open area of the substructure after the first mast section has been removably connected to the substructure. The system further includes, among other things, a second mast section that is adapted to be removably connected to the first mast section the said first mast section has been removably connected to the substructure, and a mast connection apparatus that is adapted to removably connect the second mast section to the first mast section when an upper end of the first mast section is raised relative to a lower end of the second mast section.

20 Claims, 12 Drawing Sheets

(56) References Cited

U.S. PATENT DOCUMENTS

| | | | | |
|---|---|---|---|---|
| 2,692,031 | A | 10/1954 | Woolslayer et al. | |
| 3,156,328 | A | 11/1964 | Bender | |
| 3,896,887 | A * | 7/1975 | Council | 173/193 |
| 4,471,587 | A | 9/1984 | Ahmad et al. | |
| 4,616,454 | A | 10/1986 | Ballachey et al. | |
| 4,677,444 | A | 6/1987 | Perek | |
| 4,697,779 | A | 10/1987 | Guislain | |
| 4,769,959 | A | 9/1988 | Lindsey | |
| 4,885,893 | A * | 12/1989 | Wasterval et al. | 52/745.18 |
| 6,951,082 | B2 * | 10/2005 | Nelson et al. | 52/112 |
| 7,765,749 | B2 * | 8/2010 | Palidis | 52/112 |
| 7,931,076 | B2 * | 4/2011 | Ditta et al. | 166/75.11 |
| 7,954,657 | B2 * | 6/2011 | Holly et al. | 212/177 |
| 8,414,214 | B2 * | 4/2013 | Martin | 403/85 |
| 8,534,474 | B2 * | 9/2013 | Holly et al. | 212/177 |
| 8,739,988 | B2 * | 6/2014 | Walker | 212/177 |
| 8,813,436 | B2 * | 8/2014 | Donnally et al. | 52/123.1 |
| 8,839,966 | B2 * | 9/2014 | Walker et al. | 212/177 |
| 2006/0260844 | A1 | 11/2006 | Patton et al. | |

OTHER PUBLICATIONS

PCT Search Report and Written Opinion for PCT/US2013/020923 dated Feb. 18, 2014, 10 pages.

* cited by examiner

DRILLING RIG MASTS AND METHODS OF ASSEMBLY AND ERECTION

CROSS-REFERENCE TO RELATED APPLICATIONS

This application is a continuation of U.S. application Ser. No. 12/074,258, filed Feb. 29, 2008.

BACKGROUND OF THE INVENTION

1. Field of the Invention

This invention is directed to drilling rigs; drilling rigs with an erectable mast; and to methods for erecting such a mast.

2. Description of Related Art

The prior art discloses a variety of rigs used in drilling and wellbore operations and methods of rig assembly; for example, and not by way of limitation, rigs and assembly methods as disclosed in U.S. Pat. Nos. 2,857,993; 3,340,938; 3,807,109; 3,922,825; 3,942,593; 4,021,978; 4,269,395; 4,290,495; 4,368,602; 4,489,526; 4,569,168; 4,821,816; 4,831,795; 4,837,992; 6,634,436; 6,523,319; 6,994,171; 7,306,055; 7,155,873; and 7,308,953 and the references cited in these patents—all these patents incorporated fully herein for all purposes.

In many drilling operations, drilling rigs and related systems, equipment, and apparatuses are delivered to a site, assembled and then disassembled. It is important that drilling rigs and their components be easily transported and assembled. Costs associated with land rigs and associated equipment, can be calculated on a per hour or per day basis, and, therefore, efficient assembly, takedown, transport, and setup operations are desirable.

U.S. Pat. No. 3,922,825 discloses a rig with a stationary substructure base and a movable substructure base mounted thereon which is coupled to the stationary base and swings upright into an elevated position on a series of struts that are connected to the stationary base with swivel connections at each end. The movable base is otherwise stationary since neither the stationary base nor the movable base are mobile or repositionable without the use of an auxiliary crane or the like. The movable substructure base and the drill mast are raised with a winch mounted on an auxiliary winch truck.

U.S. Pat. No. 3,942,593 discloses a mobile well drilling rig apparatus which has a trailerable telescoping mast and a separate sectionable substructure assembly with a rig base, a working floor, and a rail structure. The mast is conveyed to the top of the substructure by rollers and is raised by hydraulic raising apparatus to an upright position. With such a system the the mast assembly can be relatively long when transporting it and the mast can be unstable during raising. This system uses drawlines and winch apparatus to raise the mast onto the working floor.

U.S. Pat. No. 4,021,978 discloses a telescoping mast assembly adapted for use with drill rigs and the like. The mast assembly has multiple sections, said sections being adapted for nesting one within the other in the telescoped-to-the-closed condition and each section has mutually convergent corner leg members which, when the mast assembly is extended, form concentric and in-line arrangements of the corner leg members from the base to the crown of the mast. Means are provided for connecting each mast section to its neighboring mast section upon extension thereof. In addition, means are also provided for indexing of the connector means upon extension of the mast assembly from its telescoped-to-the-closed condition.

U.S. Pat. No. 4,821,816 discloses methods of assembling a modular drilling machine which includes a drilling substructure skid which defines two spaced parallel skid runners and a platform. The platform supports a draw works mounted on a draw works skid, and a pipe boom is mounted on a pipe boom skid sized to fit between the skid runners of the drilling substructure skid. The drilling substructure skid supports four legs which in turn support a drilling platform on which is mounted a lower mast section. The legs are pivotably mounted both at the platform and at the drilling substructure skid and a pair of platform cylinders are provided to raise and lower the drilling platform. A pair of rigid, fixed length struts extend diagonally between the platform and the substructure skid away from the platform such that the struts do not extend under the platform and obstruct access to the region under the platform. The pipe boom skid mounts a pipe boom as well as a boom linkage, a motor, and a hydraulic pump adapted to power the pipe boom linkage. The substructure skid is formed in upper and lower skid portions, and leveling rams are provided to level the upper skid portion with respect to the lower skid portion. Mechanical position locks hold the upper skid in relative position over the lower skid. In one aspect such a method for assembling an earth drilling machine includes the steps of: (a) providing a modular earth drilling machine comprising a drilling substructure skid, a draw works skid, and a pipe boom skid, the drilling structure skid having a collapsible drilling substructure platform and means for receiving the draw works skid and the pipe boom skid, the draw works skid having a draw works winch, and the pipe boom skid having a pipe boom pivotably mounted to the pipe boom skid for rotation about a pivot axis, at least one hydraulic cylinder coupled between the pipe boom and the pipe boom skid to rotate the pipe boom about the pivot axis, a hydraulic pump mounted to the pipe boom skid and coupled to the hydraulic cylinder by a closed hydraulic fluid circuit, and a pipe boom skid winch; the pipe boom skid, pipe boom, hydraulic cylinder and hydraulic pump forming a modular unit which is transportable as a single unit without any disconnection of the closed hydraulic fluid circuit; (b) positioning the substructure skid at a desired drilling position; (c) utilizing the pipe boom skid winch to pull the pipe boom skid into position with respect to the substructure skid; (d) utilizing the pipe boom skid winch to pull the draw works skid into position with respect to the substructure skid; and, in one aspect, the method further including raising the collapsible drilling structure platform, including utilizing the pipe boom skid winch to lift the drilling structure platform during at least an initial stage of the raising step.

U.S. Pat. No. 4,831,795 discloses drilling derrick assemblies which provide for the elevation above ground level of the assembly's working floor which supports both the mast and the drawworks. Prior to erection, the elevatable equipment floor is carried on a supporting substructure, and a mast is pivotally connected to the elevatable floor in a reclining position. When the assembly is erected, the mast is pivotally raised and attached in place, and other rigging steps can be carried out. Through the use of an integrally mounted sling and winch assembly or, alternatively, through operation of the assembly's traveling block, the entire equipment floor is elevated to the desired level. In one aspect, a drilling structure is disclosed that has: a substructure for supporting the drilling structure on the surface through which drilling is to occur, an elevatable floor assembly which rests on the substructure in its lowered position, a reclining mast pivotally connected to the elevatable floor, a gin pole assembly mounted on the elevatable floor assembly rearwardly of the point at which the mast is pivotally connected to the elevatable floor and arranged to receive line for raising the mast, whereby the mast is raised prior to raising the elevatable floor assembly, a collapsible vertically standing elevating frame assembly mounted on the substructure and forwardly of the mast, when raised, and the forwardmost end of the elevatable floor assembly, winch means rotatably mounted in and arranged adjacent the forwardmost end of the substructure, a first elevating block means mounted in the elevatable floor and rearwardly of the elevating frame assembly, a second elevating block mounted on the elevating frame assembly at a vertical point corresponding with the level to which the elevatable floor is to be raised, an elevating line extending from the winch means and reeved about the elevating block so that motion of the winch means in one direction causes the second elevating block to move toward the first elevating block raising the elevatable floor vertically and forwardly, motion of the winch means in another direction lowering the elevatable floor vertically and rearwardly, and a brace member on each side of the drilling structure, each brace member being pivotally connected at its ends, respectively, to the substructure and the elevatable floor, the brace members being arranged in pairs forming parallel linkages thereby causing the elevatable floor assembly to be raised in an arc-like motion.

U.S. Pat. No. 6,994,171 discloses two section masts with self-aligning connections and methods with self-aligning connections for a two section mast. The methods include the steps of transporting the elongated bottom mast section to a guide frame adjacent to a well site, the bottom mast section having a pair of front legs and a pair of rear legs. An elongated top mast section is transported to the well site, the top mast section having a pair of front legs and a pair of rear legs. The legs of the bottom mast section are positioned slightly below a level of the legs of the top mast section. Thereafter, the bottom mast section is raised slightly to order to engage the top mast section while simultaneously aligning the mast sections together. The sections are thereafter pinned together. In one method of self-aligning connections for a two section mast, the method includes: transporting an elongated bottom mast section to a guide frame adjacent to a well site, the bottom mast section having a pair of front legs and a pair of rear legs so that the bottom mast section is in a substantially horizontal orientation; thereafter transporting an elongated top mast section to the well site so that the top mast section is in a substantially horizontal orientation and so that the mast sections are substantially aligned lengthwise, the top mast section having a pair of front legs and a pair of rear legs; positioning the legs of the bottom mast section slightly below a level of the legs of the top mast section; raising the bottom mast section; and simultaneously engaging and guiding the mast sections together in a final connecting orientation.

U.S. Pat. No. 7,155,873 discloses structural connectors for a drilling rig substructure; and a method and apparatus for connecting sections of a drilling rig substructure, in one aspect a structural connector is provided so that sections of a drilling rig substructure can be connected together without the use of pins or pin-type connectors. The structural connector utilizes specially-shaped fixed members connected to, and extending through, support plates that are attached to sections of a drilling rig substructure that mate with specially-shaped mating lugs that are mounted on mating lug plates that are attached to separate sections of the drilling rig substructure. When the sections of the drilling rig substructure to be connected are positioned together, the specially-shaped mating lugs engage the specially-shaped fixed members and form a high strength structural connection between the sections of the drilling rig substructure. In one aspect a structural connector is provided that has: a plurality of support plates each having a plurality of fixed support members extending therethrough, the fixed support members extending outwardly from both sides of the support plates and having side walls and contoured tops; a mating lug assembly having a plurality of mating lug plates and a plurality of mating lugs attached to each mating lug plate, each mating lug having a support notch therein; wherein the support notch of each mating lug has tapered guide surfaces at the entry point of the support notch, side walls, and a contoured top.

BRIEF SUMMARY OF THE INVENTION

The present invention, in certain aspects, provides drilling rigs with erectable masts. In one aspect, a mast includes a bottom mast component and a second, upper or midsection component that are connected together.

In certain aspects, the present invention discloses a bottom mast section connectable to a midsection by moving a vehicle, e.g. a truck/trailer combination to place the two sections adjacent each other; connecting the bottom section to a support, e.g. but not limited to, a rig's substructure; raising, if necessary, the support or rig's substructure to which the bottom mast section is connected; and moving the vehicle to engage connections and, in one aspect, to align connections, of the bottom mast section and midsection. Once the connections have been engaged, the truck can move away and pins are used as a further securement to lock the two sections together and the truck moves away.

The present invention discloses, in certain aspects, a method for connection two parts of a mast of a drilling rig, the method including: connecting a bottom mast section to a support, the bottom mast section having bottom connection apparatus; moving a second mast section adjacent the bottom mast section, the second mast section releasably connected to a vehicle and said moving done by moving said vehicle, the second mast section having second connection apparatus; and moving the bottom mast section so that the bottom connection apparatus contacts the second connection apparatus and engages the second connection apparatus to secure the bottom mast section to the second mast section, and, in certain aspects to facilitate connection engagement and align the mast sections as one mast section is lifted.

The present invention discloses, in certain aspects, a mast system for rig operations, the mast system including: a support, a bottom mast section connected to the support; the bottom mast section having bottom connection apparatus; a second mast section adjacent and connectable to the bottom mast section, the second mast section releasably connected to a vehicle for moving the second mast section; the second mast section having second connection apparatus; and the bottom mast section movable on the support so that the bottom connection apparatus can contact the second connection apparatus and engage the second connection apparatus to secure the bottom mast section to the second mast section.

Accordingly, the present invention includes features and advantages which are believed to enable it to advance drilling rig technology and rig mast erection and assembly technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious drilling rigs, with new, useful, unique, efficient, nonobvious rig masts, and methods of their assembly and erection; and Such systems in which connections on a first mast section engage and become held in corresponding connections on a second mast section to secure the two sections together.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1A:
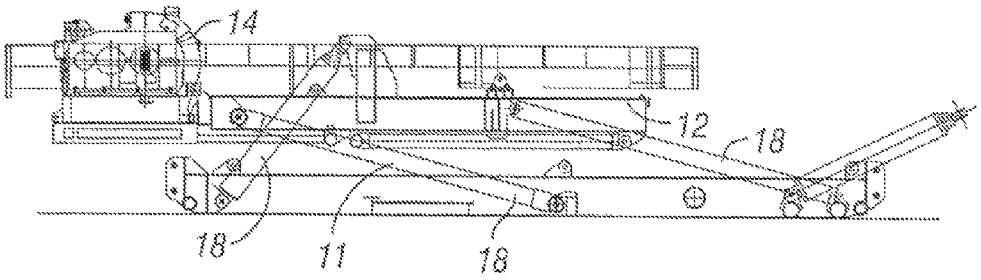
FIG. 1A is a side view of part of a drilling rig.
Figure 1B:
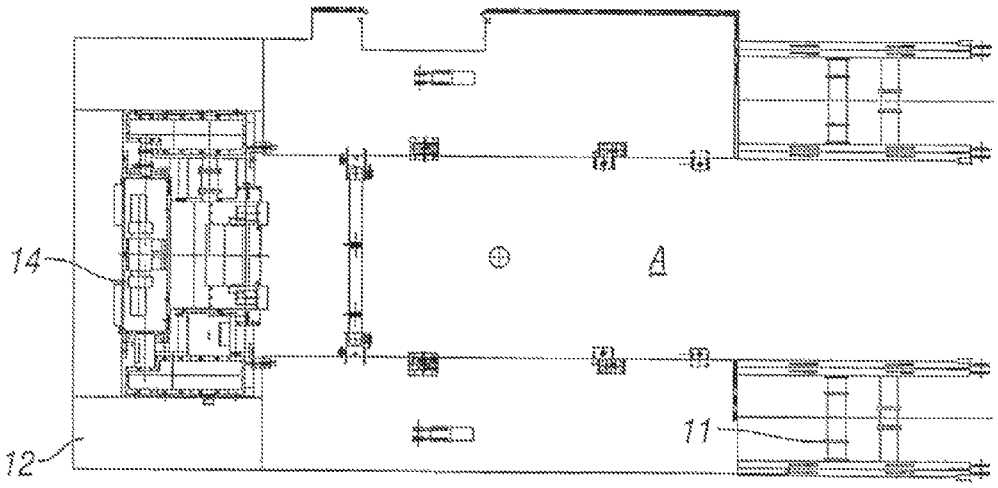
FIG. 1B is a top view of the rig parts of FIG. 1A.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness. [i. As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1A shows a drilling rig's substructure 11 supporting a drill floor 12 with a drawworks 14 positioned on the drill floor 12. The substructure 11 and drill floor 12 have an open area A into which equipment can be moved.

Figure 1C:
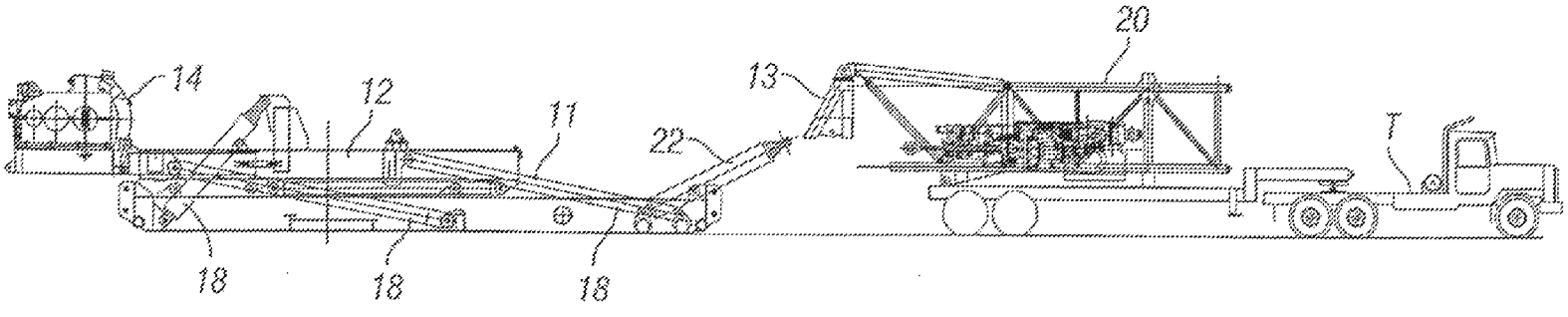
FIG. 1C is a side view which illustrates a step in a method according to the present invention for assembling and erecting a rig mast.

As shown in FIG. 1C the substructure 11 is in a lower position and a truck T has moved a bottom section 20 of a mast according to the present invention toward the drill floor 12. An A-frame 13 is connected to the bottom section 20 of the mast. Mast raising cylinders 22 are in position for connection to the bottom section 20.

Figure 1D:
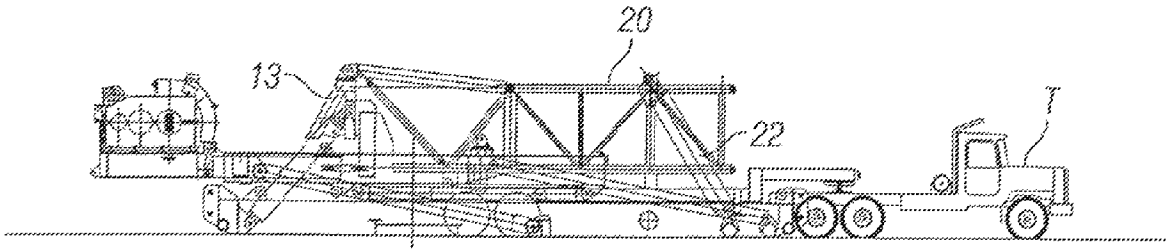
FIG. 1D is a side view which illustrates a further step in the method of FIG. 1C.

As shown in FIG. 1D, the truck T is stopped moving the bottom section 20 into the area A. The bottom section 20 is then connected to the mast raising cylinders 22. The positions substructure raising cylinders 18 are adjusted and the A-frame 13 is connected to the drill floor 12.

Figure 1E:
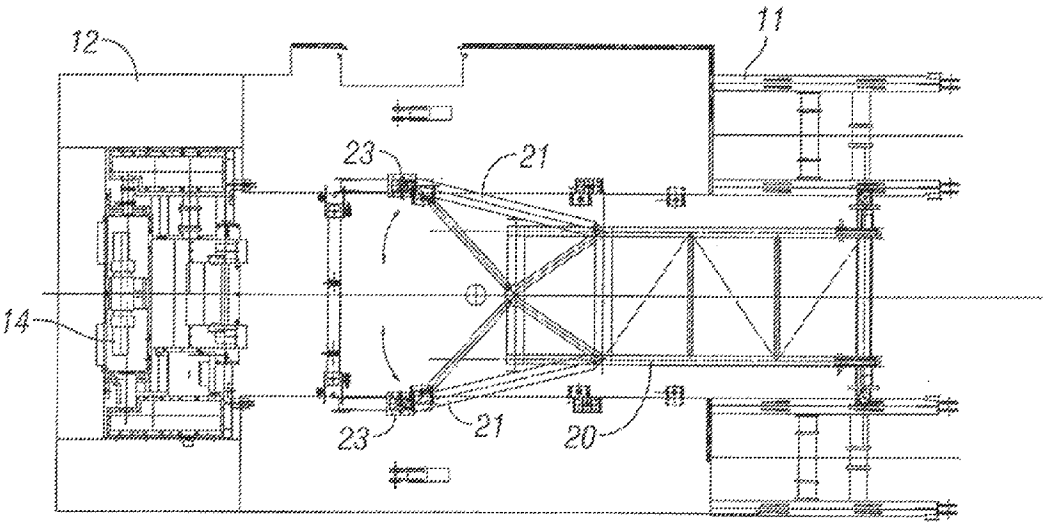
FIG. 1E is a top view of the step of FIG. 1D.

As shown in FIG. 1E, legs 21 of the mast 21 legs are swung open for bolting to mast shoes 23 of the drill floor 12. The mast raising cylinders 22 are then extended and the truck T is moved away. The mast raising cylinders 22 are then retracted to lower the bottom section 20.

Figure 1F:
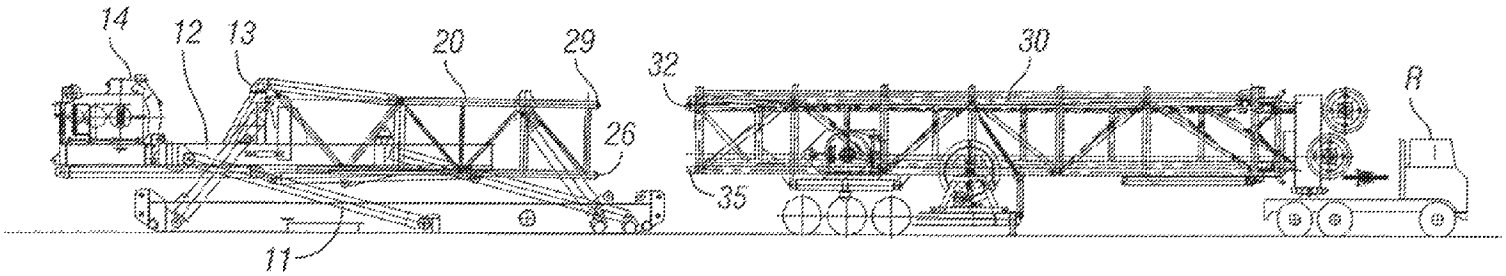
FIG. 1F is a side view of a further step in the method of FIG. 1C.
Figure 1G:
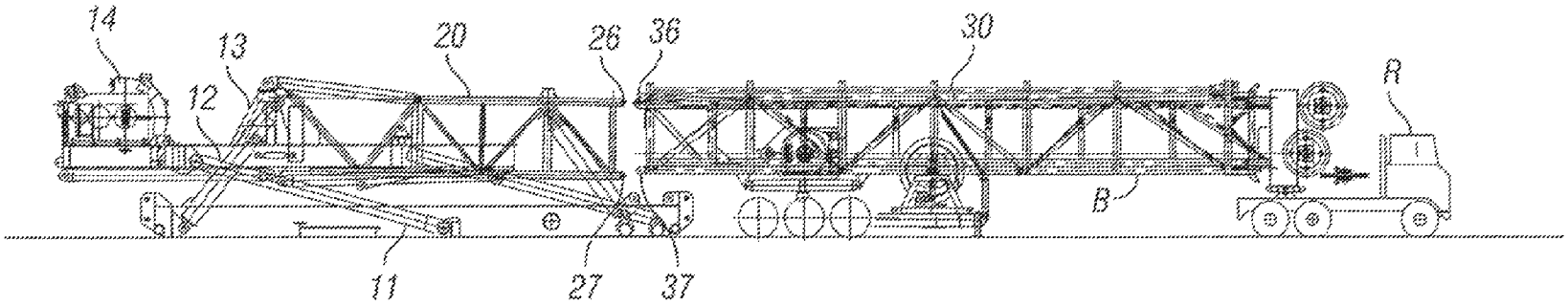
FIG. 1G is a side view of a further step in the method of FIG. 1C.

As shown in FIG. 1F, a truck R has moved a midsection 30 of a mast according to the present invention toward the bottom section 20. FIG. 1G shows the truck R stopped after moving the midsection 30 adjacent a projecting end of the bottom section 20. The sub cylinder 18 and the mast cylinder 22 are raised to raise jaw members according to the present invention of the bottom section 20 adjacent corresponding connection members 32 according to the present invention of the midsection 30.

FIGS. 1I-1L show the bottom section 20 and FIGS. 1M-1P show the midsection 30. The bottom section 20 has two legs 20*a* each with a jaw member 29 having a slot 23 in each of two spaced-apart plates 24. A space 25 is formed between ends of the plates 24. A throat 25*a* is formed between flared out portions 25*b* of the plates 24 (or separate pieces 25*b* are used connected to the plates). Two legs 20*r* each have a connection member 26 with two spaced-apart plates 27 and holes 28. A throat 27*a* is formed between flared out portions 27*b* of the plates 27. A throat 27*c* is formed between flared out portions 27*d* of the plates 27. In certain aspects of the present invention, any one or two throats described above may be deleted, or they may all be deleted.

As shown in FIGS. 1F-1L, the midsection 30 has two legs 31 each with a connection member 32 having a transverse bar 33. Each leg has a connection member 35 with holes 38 corresponding, upon section connection, to the location of the holes 28 of the connection members 26.

Ends of the connection members 32 are sized for movement into the spaces 25 of the jaw members 29 and the bars 33 are sized for receipt in the slots 23. The connection members 35 are sized for receipt between the plates 27 of the connection members 26 and pins are insertable through the holes 28, 38 to lock the two mast sections together. If one jaw member connects to one connection member and the other jaw-member/connection/member connection has not been fully effected, raising of the bottom section will force the other connection member into contact with and engagement with the other jaw member, facilitating alignment of the two sections and their connection.

The truck R moves the midsection 30 adjacent the bottom section 20 so that ends of the connection members 32 move into the spaces 25 of the jaw member 29 and the bars 33 then move into the slots 23. The connection members 35 are moved through the throats 27*a* between the plates 27 and pins are inserted through the holes 28, 38 to lock the two sections together.

It is within the scope of this invention to delete one of the jaw members 29 and to releasably connect the two sections of the mast together at the location of the deleted jaw member 29 in any suitable fashion (e.g., but not limited to) with bolt(s) bolting the two sections together.

Figure 1H:
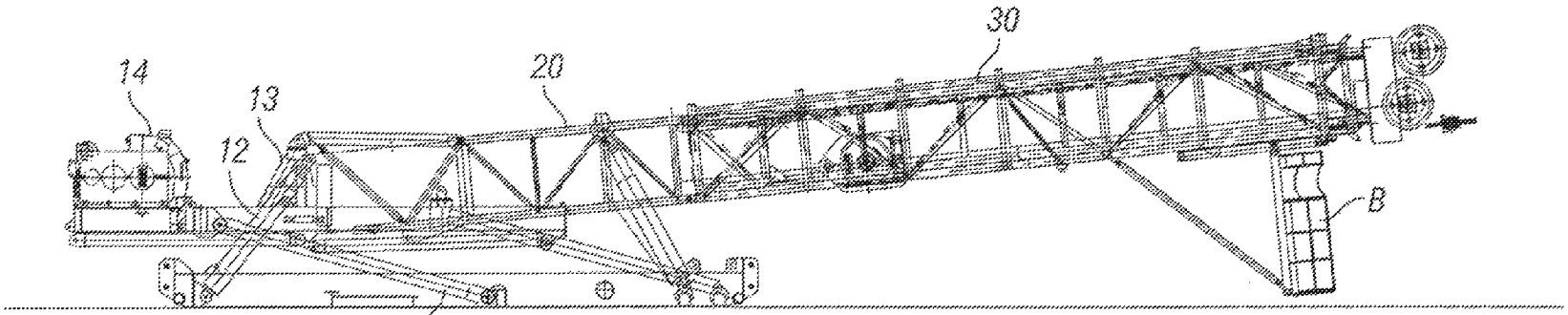
FIG. 1H is a side view of a further step in the method of FIG. 1C.
Figure 1I:
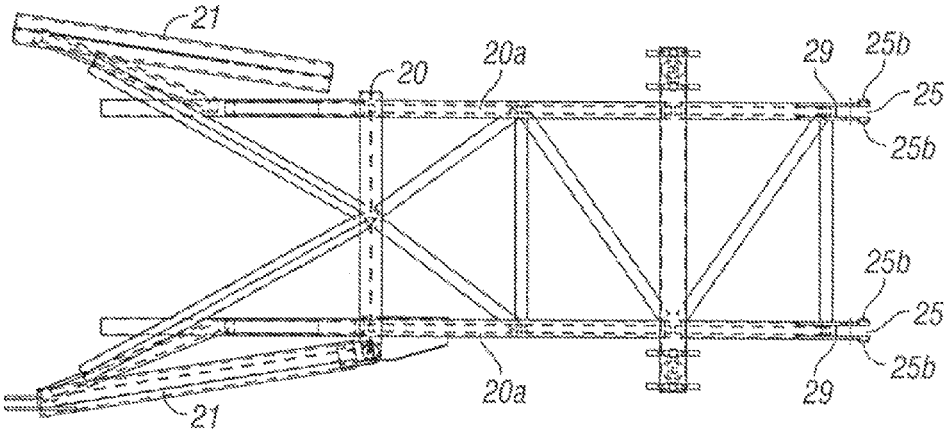
FIG. 1I is a top view of a bottom section of a mast as assembled in FIGS. 1C-1H.
Figure 1J:
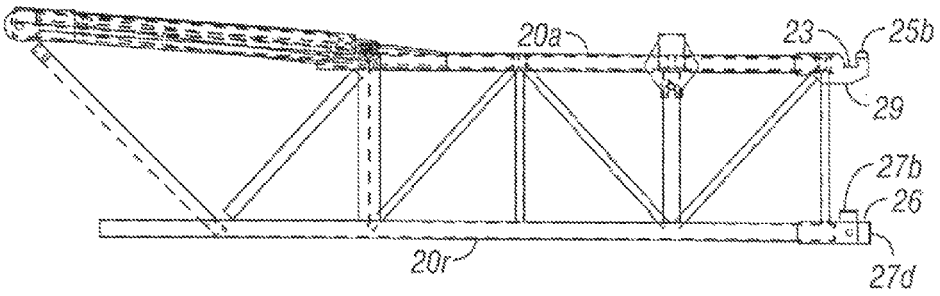
FIG. 1J is a side view of the bottom section of FIG. 1I.
Figure 1K:
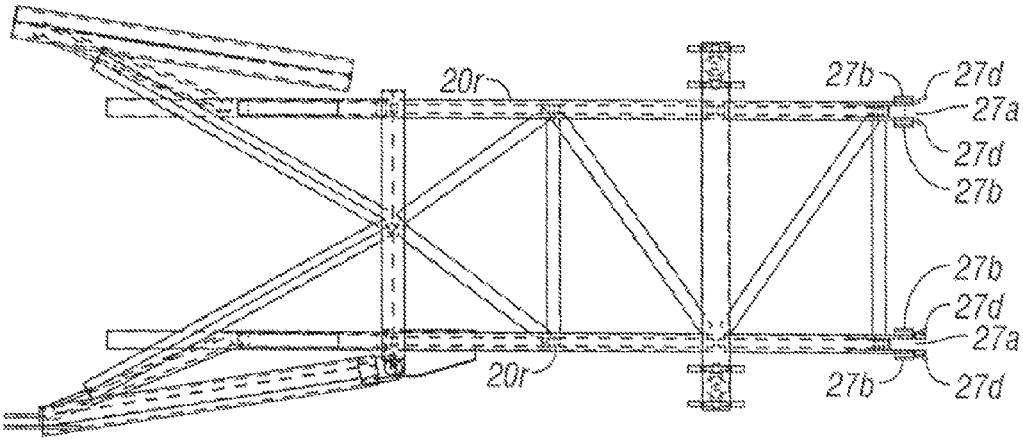
FIG. 1K is a bottom view of the bottom section of FIG. 1I.
Figure 1L:
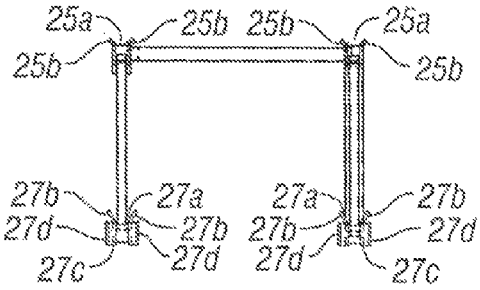
FIG. 1L is an end view along the bottom section of FIG. 1I.
Figure 1M:
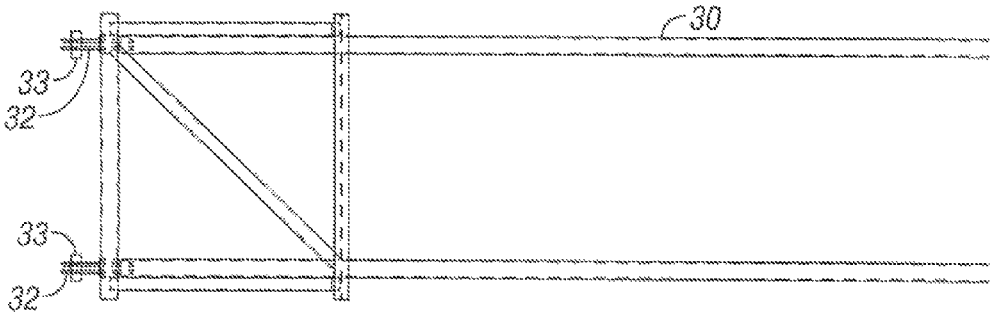
FIG. 1M is a side view of the bottom midsection of a mast as assembled in FIG. 1F, et seq.
Figure 1N:
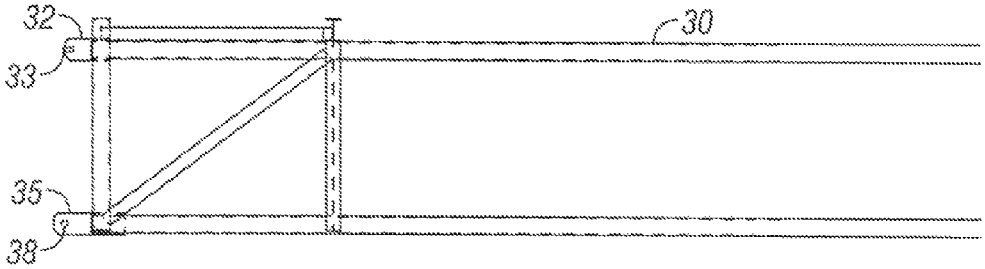
FIG. 1N is a side view of the bottom midsection of FIG. 1M.
Figure 1O:
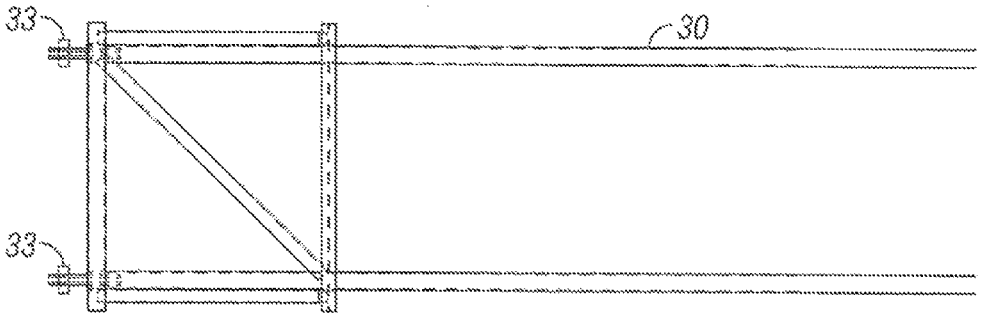
FIG. 1O is a bottom view of the bottom midsection of FIG. 1M.
Figure 1P:
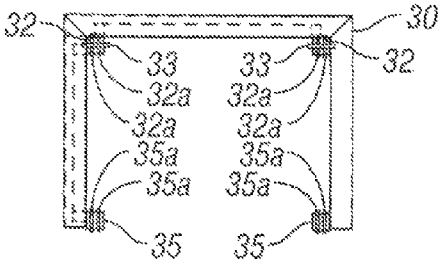
FIG. 1P is an end view along the bottom section of FIG. 1N.

Upon interengagement of the connection members of the sections 20, 30, as shown in FIG. 1H, and insertion of locking pins through the holes 28, 38, the mast raising cylinders 22 are partially extended so the truck R can move away. The mast raising cylinders 22 are then further extended and a racking board B is opened.

Figure 2:
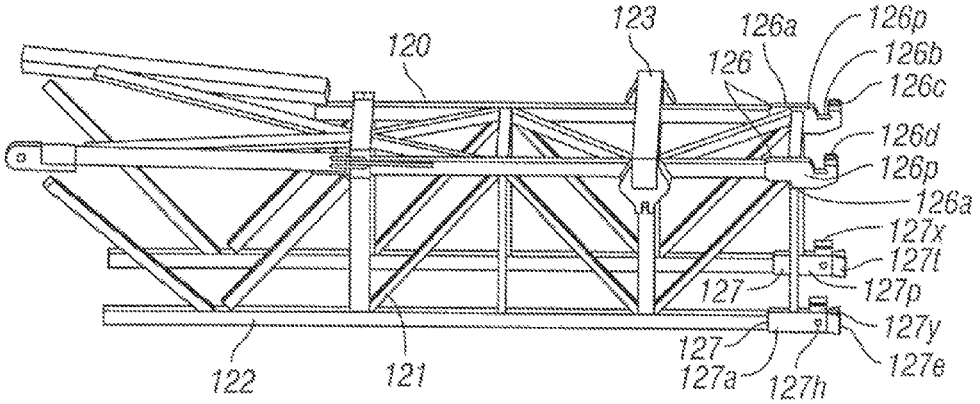
FIG. 2 is a perspective view of a bottom section of a mast according to the present invention connected to rig substructure (shown partially).
Figure 3:
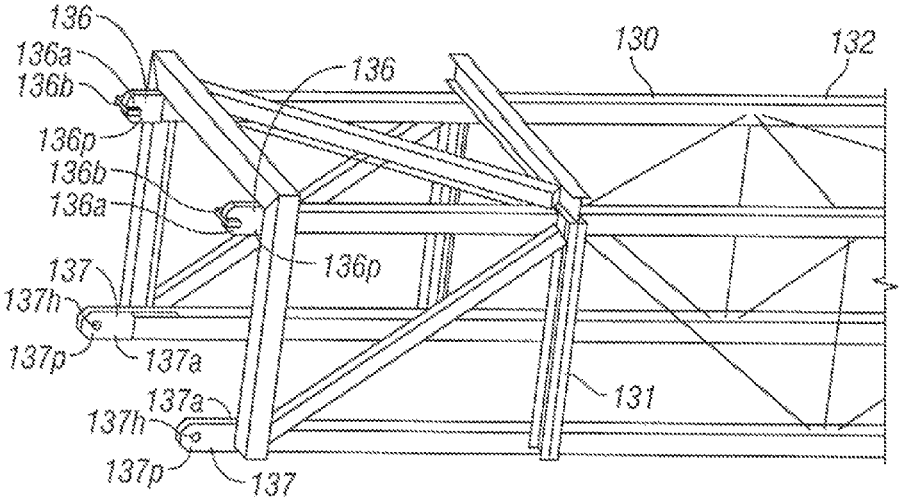
FIG. 3 is a perspective view of a midsection of a mast according to the present invention.

FIG. 2 shows a bottom section 120 of a mast according to the present invention (like the bottom section 20); and FIG. 3 shows a midsection 130 of a mast according to the present invention (like a midsection 30).

As shown in FIG. 2, the bottom section 120 has four legs 122 and a series of interconnecting beams 121. A square tube 123 spans two of the legs 122. Each of two of the legs 122 has a jaw member 126 like the jaw members 29, FIG. 1F and the two opposite legs 122 have end connection members 127 (like the connection members 27, FIG. 1F).

A jaw member 126 has a body 126*a* which includes two spaced-apart plates 126*p* secured to a leg 122; a slot 126*b*; an upright projection 126*c*; and a throat 126*d* (like the throat 25*a*, FIG. 1L) between two flared out parts which decreases in width from an outer end to an inner end.

An end connection member 127 has a body 127*a* with two spaced-apart plates 127*p* each with a flared end 127*e* so that the plates 127*p* together form an open throat 127*t* which decreases in width from the outer end to the inner end. Each plate 127*p* has a hole 127*h* for receiving a removable locking pin. A throat 127*x* is formed between parts 127*y*. The throat 127*t* is like the throat 27*c*, FIG. 1L and the throat 127*x* is like the throat 27*a*, FIG. 1L.

As shown in FIG. 3, the midsection 30 has four legs 132 and a series of interconnecting beams 131. Each of two of the legs 132 has a connection member 136 and the two opposite legs have a connection member 137.

Each connection member 136 has a body 136*a* made of two plates 136*p*. A bar 136*b* is held by and projects slightly from the plates 136*p*.

Each connection member 137 has a body 137*a* made of two plates 137*p*. Each plate 137*p* has a hole 137*h* for receiving a removable locking pin.

Figure 4A:
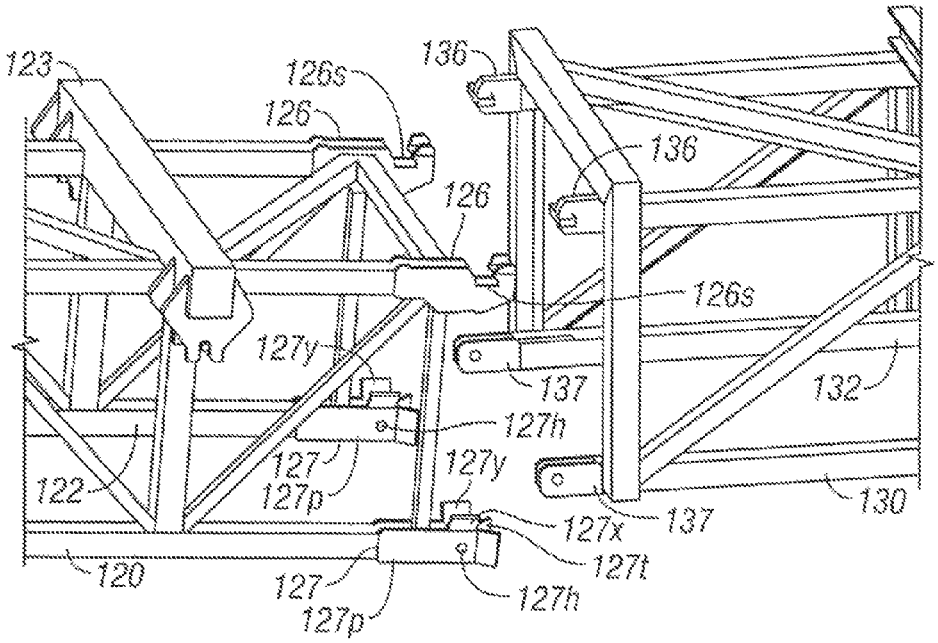
FIG. 4A is a perspective view illustrating a bottom section as in FIG. 2 for connection to a midsection as in FIG. 3.
Figure 4B:
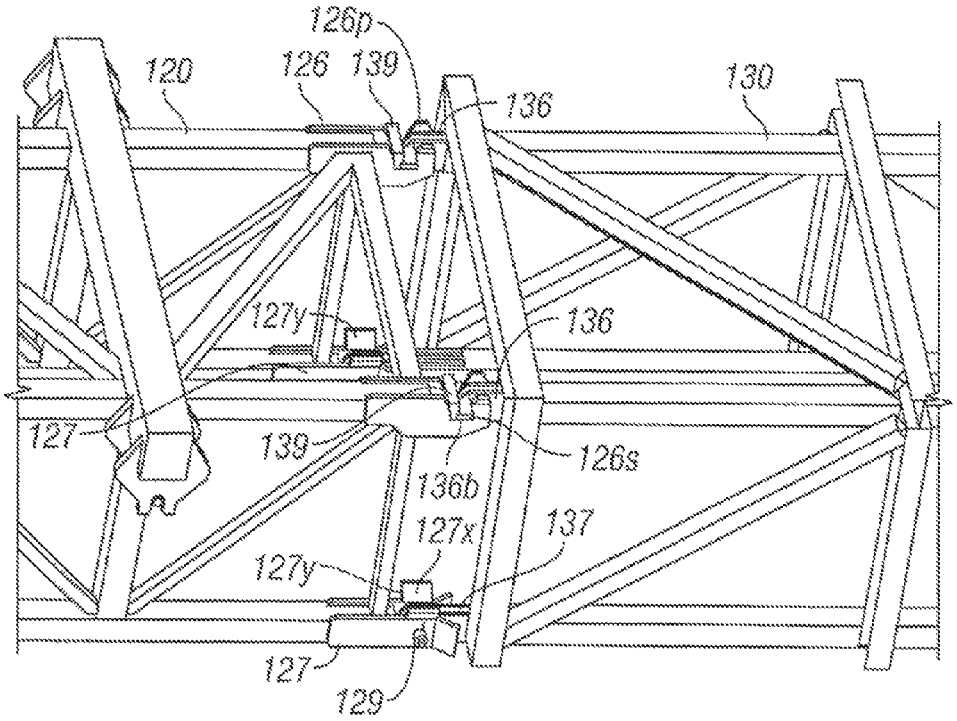
FIG. 4B shows the bottom section of FIG. 4A connected to the midsection of FIG. 4A.
Figure 4C:
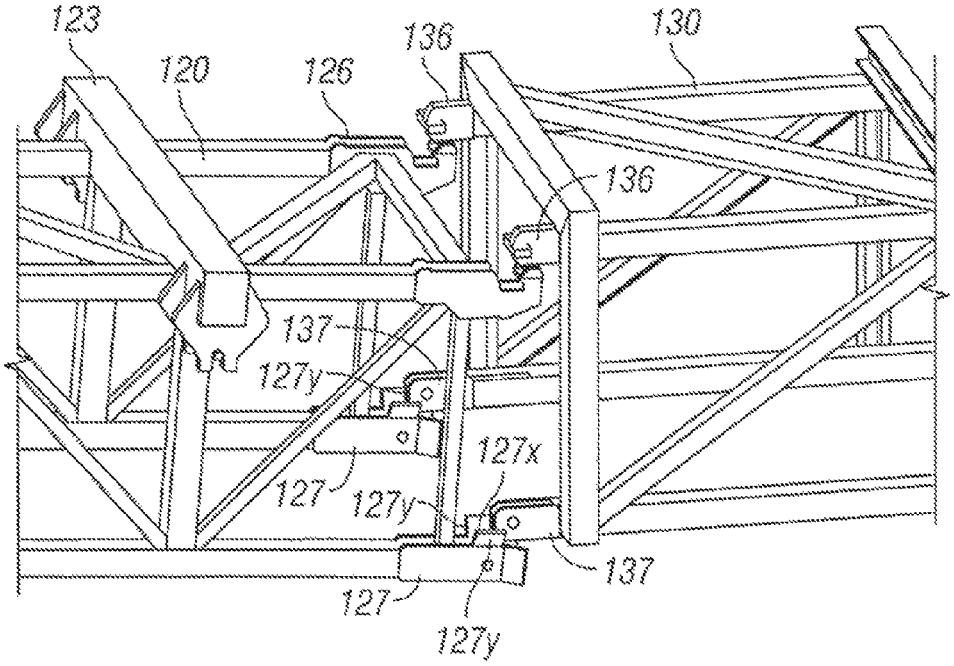
FIG. 4C is a perspective view illustrating a step in a method of connecting the sections shown in FIG. 4A.
Figure 4D:
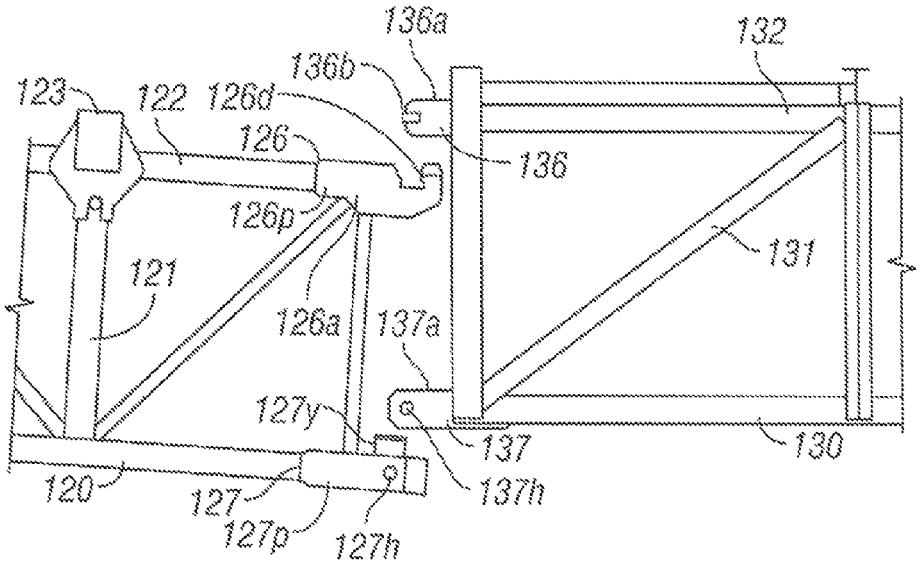
FIG. 4D is a side view illustrating a further step in the method of FIG. 4C.
Figure 4E:
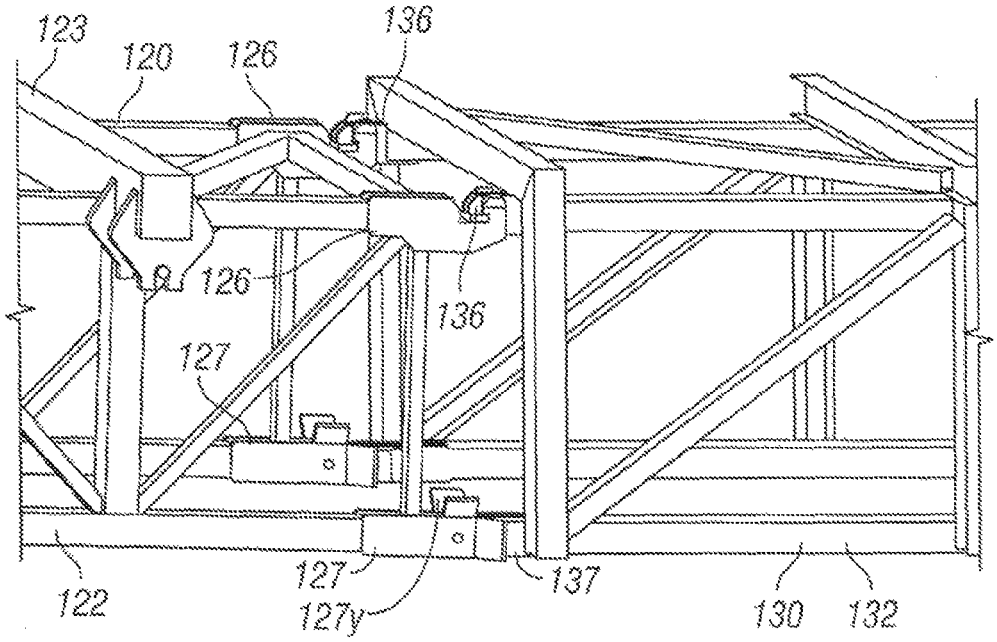
FIG. 4E is a perspective view of a further step in the method.

As shown in FIGS. 4A-4C the midsection 130 has been moved on a truck into position adjacent the bottom section 120 (e.g. as in FIG. 1F and prior to FIG. 1G). The truck moves the midsection 130 directly above the bottom section 120 (FIG. 4C). A substructure (e.g. like the substructure 11) raises the bottom section. For mating of the upper mast section initially to the lower mast section, both sections are oriented so that they are sloping downwards towards each other to insure that the upper jaws 126 come to a mating position before the opposite connections. The jaws 126 are then brought into contact with the mating bars 136*b* of the lower connection members by raising the lower mast section using the hydraulic cylinders.

Figure 4F:
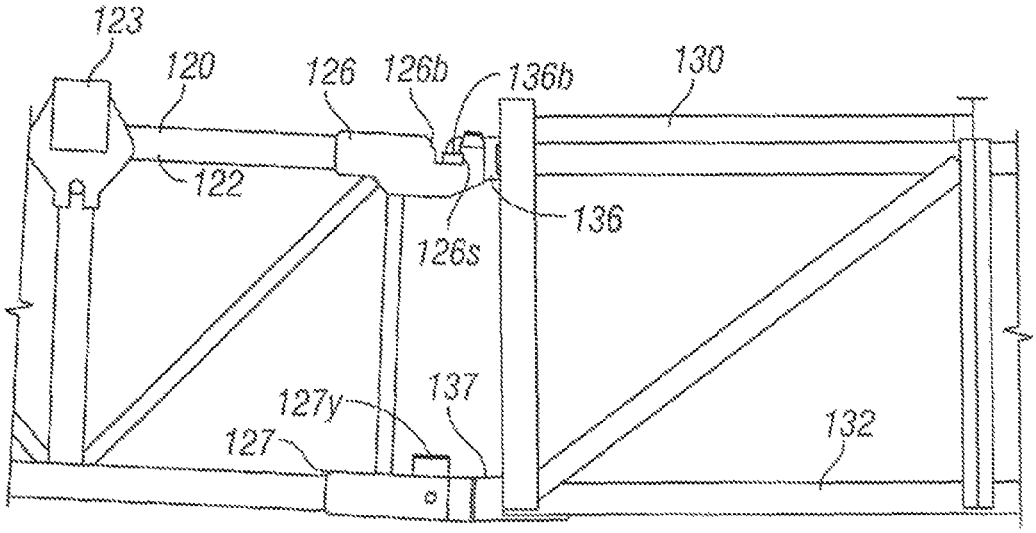
FIG. 4F is a side view of the step of FIG. 4E.
Figure 4G:
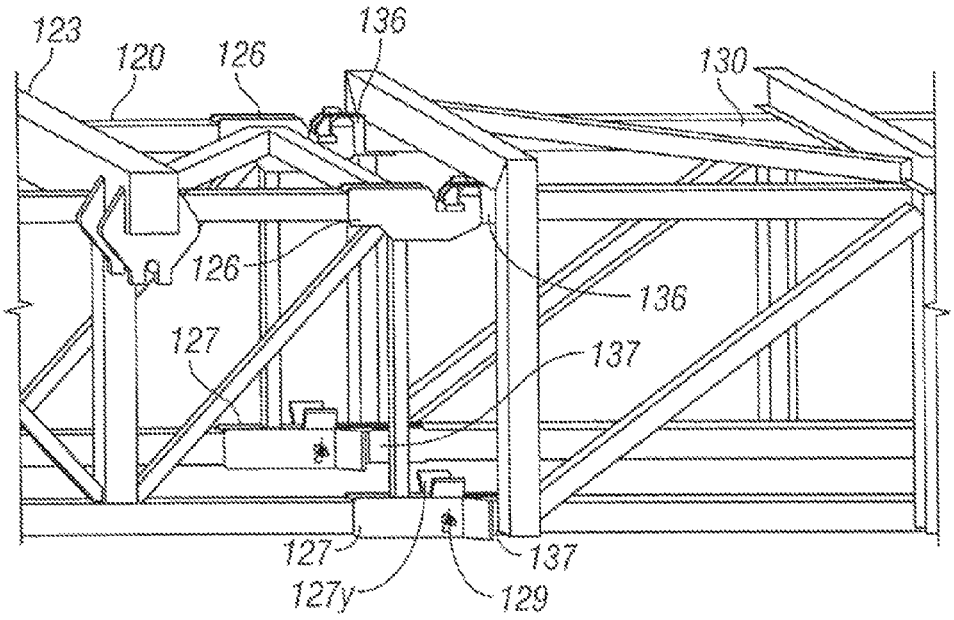
FIG. 4G is a perspective view illustrating a further step in the method.

Continued raising then forces the mating ends of the mast sections upwards rotating them so that the gap between the lower connections is forced closed. The flared design on the lower connections forces them into alignment as they are forced closed. As shown in FIGS. 4F and 4G, the hydraulic cylinders (substructure raising cylinders and mast raising cylinders) have been raised to raise the bottom section 120 level with the midsection 130, moving the connection member 137 fully into the connection member 127. Pins 129 have not yet been inserted into and through the holes 127*h*, 137*h*. The bars 136*b* are in the slots 126*s*. The two sides of the mast can be misaligned when the connection method starts which can result in a jaw and bar on one side being tensioned while the opposite jaw and bar are floating—but this is self-corrected as the raising process continues and the total mast begins to be lifted.

Figure 4H:
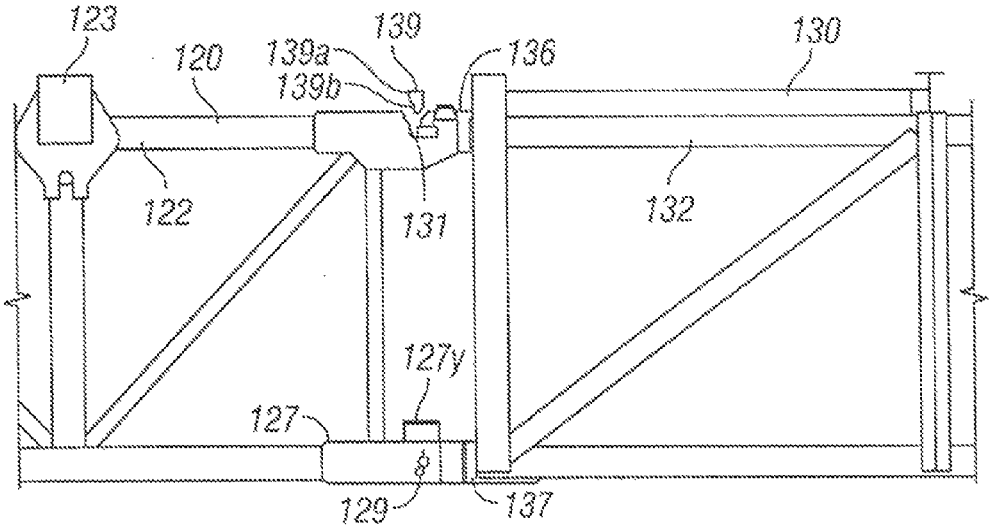
FIG. 4H is a side view of the step shown in FIG. 4G.

As shown in FIGS. 4G and 4H, the substructure raising cylinders and the mast raising cylinders have been adjusted to install the pins 129 have been inserted through the connection member 127, 137. Pins 139 have not yet been inserted into the slots 126*b*. Each pin 139 has a body 139*a* with a lower projection 139*c* which is sized and configured to fit into a space 131 formed by surfaces of the connection member 126 and of the bars 136*b*.

Once the pins 139 have been inserted and the two mast sections 120, 130 are connected, the mast is ready to be raised.

The present invention, therefore, provides in some, but not in necessarily all, embodiments a method for connection two parts of a mast of a drilling rig, the method including: connecting a bottom mast section to a support, the bottom mast section having bottom connection apparatus; moving a second mast section adjacent the bottom mast section, the second mast section releasably connected to a vehicle and said moving done by moving said vehicle, the second mast section having second connection apparatus; and moving the bottom mast section so that the bottom connection apparatus contacts the second connection apparatus and engages the second connection apparatus to secure the bottom mast section to the second mast section. Such a method may one or some, in any possible combination, of the following: releasing the second mast section from the vehicle, and moving the vehicle away from the second mast section; raising with mast raising apparatus the mast comprising the bottom mast section secured to the second mast section; wherein the support is a substructure with raising apparatus, the method further including: raising the substructure with the raising apparatus to move the bottom mast section with respect to the second mast section to facilitate engagement of the bottom connection apparatus with the second connection apparatus; locking together the bottom connection apparatus and the second connection apparatus; the bottom mast section comprises a jaw member connected to the bottom mast section with a throat and a slot, the second connection apparatus comprises a an insertion member with a bar, the insertion member sized and located for receipt of an end thereof in the throat of the jaw member and the bar sized and located for receipt within the slot, the method further including moving the bottom mast section to move the end of the insertion member into the throat and to move the bar into the slot; the jaw member has two spaced-apart plates each with a flared portion and a throat defined between the flared portions, the method further including moving an end of the insertion member into the throat; the bottom mast section is two legs each with a jaw member connected thereto, each with a throat and a slot, the second connection apparatus comprises an insertion member with a bar, the insertion member sized and located for receipt of an end thereof in the throat of the jaw member and the bar sized and located for receipt within the slot, the method further including moving the bottom mast section to move the ends of the insertion members into the throats and to move the bars into the slots; the jaw member has two spaced-apart plates each with a flared portion and a throat defined between the flared portions, the method further including moving an end of the insertion member into the throat; wherein the bottom mast section has a primary connection member connected thereto and spaced-apart from the jaw member, the second mast section has a secondary connection member connected thereto, the method further including securing the secondary connection member to the primary connection member; the primary connection member has two spaced-apart plates each with an outwardly flared portion and includes a throat between the outwardly flared portions of the two spaced-apart plates for facilitating entry of part of the secondary connection apparatus between the two spaced-apart plates; the bottom mast section has two legs each with a primary connection member connected thereto and spaced-apart from a jaw member, the second mast section has two legs each with a secondary connection member connected thereto, the method further including securing the secondary connection members to the primary connection members; the primary connection members each have two spaced-apart plates each with an outwardly flared portion and include a throat between the outwardly flared portions of the two spaced-apart plates for facilitating entry of part of the secondary connection apparatuses between the two spaced-apart plates; and/or wherein the support is a substructure with raising apparatus, the method further including raising the substructure with the raising apparatus to move the bottom mast section with respect to the second mast section to engage the bottom connection apparatus with the secondary connection apparatus, and said raising aligning the bottom mast section with the second mast section as the substructure is raised.

The present invention, therefore, provides in some, but not in necessarily all, embodiments a mast system for rig operations, the mast system including: a support, a bottom mast section connected to the support; the bottom mast section having bottom connection apparatus; a second mast section adjacent and connectable to the bottom mast section, the second mast section releasably connected to a vehicle for moving the second mast section; the second mast section having second connection apparatus; and the bottom mast section movable on the support so that the bottom connection apparatus can contact the second connection apparatus and engage the second connection apparatus to secure the bottom mast section to the second mast section. Such a mast system may one or some, in any possible combination, of the following: wherein the support is a substructure with raising apparatus, the substructure with the raising apparatus able to raise the bottom mast section with respect to the second mast section prior to facilitate engagement of the bottom connection apparatus with the second connection apparatus; locking apparatus for locking together the bottom connection apparatus and the second connection apparatus; the bottom mast section having a jaw member connected to the bottom mast section, the jaw member having a throat and a slot, the second connection apparatus comprising an insertion member with a bar, the insertion member sized and located for receipt of an end thereof in the throat of the jaw member and the bar sized and located for receipt within the slot, and the bottom mast section movable to move the end of the insertion member into the throat and to move the bar into the slot; the jaw member has two spaced-apart plates each with a flared portion and a throat defined between the flared portions, the throat for receipt therein of an end of the insertion member into the throat; the bottom mast section having two legs each with a jaw member connected to a leg and each with a throat and a slot, the second mast section having two legs each with a second connection apparatus comprising an insertion member with a bar, the insertion member sized and located for receipt of an end thereof in the throat of a jaw member and the bar sized and located for receipt within a slot of the jaw member, and the bottom mast section movable to move the ends of the insertion members into the throats and to move the bars into the slots; the bottom mast section having a primary connection member connected thereto and spaced-apart from the jaw member, the second mast section having a secondary connection member connected thereto, and the secondary connection member securable to the primary connection member; and/or the bottom mast section has two legs each with a primary connection member connected thereto and spaced-apart from a jaw member, the second mast section has two legs each with a secondary connection member connected thereto, and each secondary connection member securable to an adjacent primary connection member; the primary connection member has two spaced-apart plates each flared out and including a throat defined between the two spaced-apart plates for facilitating entry of part of the second connection apparatus between the two spaced-apart plates.

The systems and methods of the inventions described in the following pending U.S. patent applications, co-owned with the present invention, filed on even date herewith, naming donnally et al as inventors, fully incorporated herein for all purposes, may be used with certain embodiments of the present invention, the applications entitled: "Drilling Rig Structure Installation And Methods"; "Drilling Rig Drawworks Installation"; and "Drilling Rigs And Erection Methods".

In conclusion, therefore, it is seen that the present invention and embodiments disclosed herein and those in the appended claims are well adapted to do the objectives and obtain the ends set forth. Certain changes can be made in the subject matter without departing from the spirit and the scope of this invention. Changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are including, but items not specifically mentioned are not excluded. A reference to an element by the indefinite article "a" does not exclude the possibility that more than one of the element is present, unless the context clearly requires that there be one and only one of the elements.

What is claimed is:

1. A system for erecting a drilling rig mast, the system comprising:

a substructure comprising a mast connection, a first substructure subassembly, and a second substructure subassembly that is adapted to be positioned laterally adjacent to and spaced apart from said first substructure subassembly so as to define an open area therebetween and an opening between adjacent ends thereof, said open area being adapted to at least partially receive a wheeled mast moving apparatus that is used to move a mast section through said opening and adjacent to said mast connection;

a bottom mast section comprising a first connection apparatus positioned at an upper end thereof and a bottom connection apparatus positioned at a lower end thereof, said bottom connection apparatus being adapted to be pivotably connected to said mast connection, wherein said bottom mast section is adapted to be moved through said opening and positioned at least partially within said open area; and a second mast section comprising a second connection apparatus positioned at a lower end thereof, wherein said first connection apparatus is adapted to engage with and be removably connected to said second connection apparatus when said bottom mast section is pivotably rotated about said mast connection.

2. The system of claim 1, further comprising a raising apparatus that is adapted to raise said first connection apparatus of said bottom mast section relative to said second connection apparatus by pivotably rotating said bottom mast section about said mast connection.

3. The system of claim 1, further comprising a locking apparatus that is adapted to lock said first connection apparatus to said second connection apparatus.

4. The system of claim 1, wherein said first connection apparatus comprises a jaw member comprising a throat and a slot and said second connection apparatus comprises an insertion member comprising a bar, an end of said insertion member being adapted to be positioned in said throat of said jaw member and said bar being adapted to be positioned within said slot when said first connection apparatus engages with said second connection apparatus.

5. The system of claim 4, wherein the jaw member comprises two spaced-apart plates, each of said two spaced apart plates having a flared portion, said flared portions defining said throat of said jaw member.

6. The system of claim 1, wherein said bottom mast section comprises a plurality of first bottom legs and said first connection apparatus comprises a jaw member connected to each of said plurality of first bottom legs, each of said jaw members comprising a throat and a slot.

7. The system of claim 6, wherein said second mast section comprises a plurality of first mast legs and said second connection apparatus comprises an insertion member connected to each of said first mast legs, said insertion member comprising a bar, wherein an end of each of said insertion members is adapted to be positioned in a throat of a respective jaw member and each of said bars is adapted to be positioned within a slot of a respective jaw member when said first connection apparatus engages with said second connection apparatus.

8. The system of claim 7, wherein said bottom mast section comprises a plurality of second bottom legs that are spaced apart from said first bottom legs and said second mast section comprises a plurality of second mast legs that are spaced apart from said first mast legs, an upper end of each of said plurality of second bottom legs comprising an upper connection member and a lower end of each of said plurality of second mast legs comprising a lower connection member that is adapted to be coupled to a respective upper connection member.

9. The system of claim 1, further comprising a mast raising apparatus.

10. The system of claim 9, wherein said mast raising apparatus is adapted to be pivotably connected to said bottom mast section and said substructure.

11. The system of claim 9, wherein said mast raising apparatus is adapted to raise at least said bottom mast section after said bottom connection apparatus has been pivotably connected to said mast connection.

12. The system of claim 9, wherein said mast raising apparatus is adapted to raise an assembled drilling rig mast comprising at least said bottom mast section and said second mast section.

13. The system of claim 1, wherein a lateral width of a portion of said bottom mast section that is adapted to be moved through said opening and positioned at least partially within said open area is less than a lateral width of said open area.

14. A system for erecting a drilling rig mast, the system comprising:

a substructure having an open area therein that is partially defined by two laterally spaced-apart substructure subassemblies, wherein said open area is adapted to at least partially receive a wheeled mast moving apparatus that is used to move a mast section adjacent to said substructure;

a first mast section that is adapted to be moved by said wheeled mast moving apparatus through an opening defined by adjacent ends of said two laterally spaced-apart substructure subassemblies, said first mast section being further adapted to be positioned at least partially within said open area of said substructure after said first mast section has been removably connected to said substructure, a second mast section that is adapted to be removably connected to said first mast section after said first mast section has been removably connected to said substructure; and a mast connection apparatus that is adapted to removably connect said second mast section to said first mast section when an upper end of said first mast section is raised relative to a lower end of said second mast section.

15. The system of claim 14, further comprising a mast raising apparatus that is adapted to raise said upper end of said first mast section relative to said lower end of said second mast section by pivotably rotating said first mast section about a lower end of said first mast section, wherein said lower end of said first mast section is adapted to removably connect said first mast section to said substructure.

16. The system of claim 15, wherein said mast connection apparatus comprises at least one jaw member connected to said upper end of said first mast section and at least one insertion member connected to said lower end of said second mast section.

17. The system of claim 16, wherein said at least one jaw member comprises a throat and a slot and said at least one insertion member comprises a bar, an end of said at least one insertion member being adapted to be positioned in said throat of said at least one jaw member and said bar being adapted to be positioned within said slot when said mast connection apparatus removably connects said second mast section to said first mast section.

18. The system of claim 14, wherein said mast raising apparatus is adapted to be pivotably connected to said first mast section and said substructure.

19. The system of claim 14, wherein said mast raising apparatus is further adapted to raise an assembled drilling rig mast comprising at least said first mast section and said second mast section.

20. The system of claim 14, wherein a lateral width of a portion of said first mast section that is adapted to be moved through said opening and positioned at least partially within said open area is less than a lateral width of said open area.

* * * * *